US006109347A

United States Patent [19]

Ferguson et al.

[11] Patent Number: 6,109,347

[45] Date of Patent: Aug. 29, 2000

[54] ONE-TRIP, THRU-TUBING, WINDOW-MILLING SYSTEM

[75] Inventors: Andy Ferguson, Spring; Edgar D. Lueders, Stafford, both of Tex.

[73] Assignee: Baker Hughes Incorporated, Houston, Tex.

[21] Appl. No.: 09/098,919

[22] Filed: Jun. 17, 1998

Related U.S. Application Data

[60] Provisional application No. 60/051,741, Jul. 3, 1997.

[51] Int. Cl.[7] ..... E21B 29/00

[52] U.S. Cl. ..... 166/55.7; 166/298; 166/117.5

[58] Field of Search ..... 166/55.6, 55.7, 166/297, 298, 117.5

[56] References Cited

U.S. PATENT DOCUMENTS

| | | | |
|---|---|---|---|
| 2,014,805 | 9/1935 | Hinderliter | 166/55.7 |
| 5,109,924 | 5/1992 | Jurgens et al. | 166/117.5 |
| 5,697,438 | 12/1997 | Rehbock et al. . | |
| 5,791,417 | 8/1998 | Haugen et al. | 166/298 |
| 5,887,655 | 3/1999 | Haugen et al. | 166/298 |

FOREIGN PATENT DOCUMENTS

| | | |
|---|---|---|
| 2308139 | 6/1997 | United Kingdom . |
| 2313391 | 11/1997 | United Kingdom . |
| WO 97/27380 | 7/1997 | WIPO . |

*Primary Examiner*—William Neuder
*Assistant Examiner*—Zakiya Walker
*Attorney, Agent, or Firm*—Duane, Morris & Heckscher LLP

[57] ABSTRACT

A one-trip, window-milling system method and apparatus is disclosed. The system is particularly useful in thru-tubing applications where the mills are run on coiled tubing in conjunction with a downhole motor. Preferably, the whipstock is run through tubing and set in position. The mill assembly is typically run in after the thru-tubing whipstock is oriented and set. The mill assembly is supported by a downhole motor, which is in turn run-in with coiled tubing. The pilot mill or leading mill is of a particular shape so as to minimize its torque requirements for initiating the window. A wear device, which acts as a guide, is located behind the initial mill and acts with a flexible connector above the subsequent mills in orienting the initial mill into the casing and away from the whipstock. The subsequent mill or mills feature a gradual increase in cross-sectional area along its or their length, also minimizing the required torque for the downhole motor. The system is capable of penetrating thick casing such as standard weight 7" casing in approximately 3 hours or less.

15 Claims, 4 Drawing Sheets

ONE-TRIP, THRU-TUBING, WINDOW-MILLING SYSTEM

This application is based on a provisional application No. 60/051,741 filed on Jul. 3, 1997.

FIELD OF THE INVENTION

The field of this invention relates to one-trip milling of windows in casing, particularly applications where a thru-tubing whipstock is employed and the milling system is installed through tubing while being operated with a downhole motor supported on coiled tubing.

BACKGROUND OF THE INVENTION

Various one-trip, window-milling systems have been used in the past. In U.S. Pat. No. 5,109,924, issued to Jurgens, a pilot mill is combined with a series of watermelon mills for use in conjunction with a whipstock to mill a window. This system is not made for thru-tubing applications. In U.S. Pat. No. 5,445,222, a whipstock is separately installed on tubing and the tubing is removed. An assembly is then installed on tubing, which comprises a pilot mill with a tapered cutting surface, followed by subsequent stages of spiral-type mills which are progressively larger as they get more remote from the pilot mill. Wear pads are randomly distributed above and below each of the spiral mills. The pilot mill is formed into a cone-shaped head. The assembly is rotated from the surface while drilling fluid is circulated through the drill-string which rotates the mills. Both these techniques require the additional time to pull the production tubing. A thru-tubing application, particularly that runs on coiled tubing which cannot itself be rotated, requires the use of a downhole motor to rotate the milling assembly.

In the past, cement plugs have been used in conjunction with bent subs installed through tubing to try to mill a window. Thus, for example, in a 7" cased hole with a cement plug, and having 4½" production tubing, a window has been attempted using a bent sub. The system was not one-trip as the initial mill had to be replaced before it made sufficient penetration. The problem in the past has been that the torque output of the downhole motor presents a limiting factor on the milling operation. The result in past attempts to conduct milling with a downhole motor, in conjunction with a whipstock, have led to unacceptable penetration times coupled with the need to change pilot mills which wore prior to making a full penetration.

Thus, use of mills with sharp angles, which are suitable for systems operated with tubing rotated from the surface, become impractical when the driver is a downhole motor.

Accordingly, what is needed is a truly one-trip system that can operate through tubing in conjunction with a whipstock that can be inserted through tubing where the window can be milled in a single trip using a downhole motor as the driver. The apparatus and method that has been developed allows for smooth operation which is an aid in improving the penetration rate. The configuration of the starter mill, and how it is disposed with respect to the whipstock, are also factors in reducing the milling time required for the penetration of the initial mill into the casing. Apart from the configuration of the starter mill and proper facilities to orient it at the casing, another factor that contributes to the objective of the invention is the sharing of the milling job to make the complete window between the starter mill and subsequent mills, which help stabilize the assembly. Additionally, the specific design of the orientation device for the starter mill also significantly adds to the smoothness of its operation, minimizes cutter breakage, and facilitates the return of circulating fluid and cuttings to the surface. These features, singly and together, contribute to the objective of the present invention which is to provide a one-trip, thru-tubing system that can operate in conjunction with a whipstock to make a window in the casing in a single trip in a short amount of time, using a downhole motor as the driver.

In the past, when attempts have been made to mill an exit through a casing through tubing, using a downhole motor, a one-trip system was not possible. The reason was that the initial mill could not complete the milling operation sufficiently to allow the second mill to finish the hole. In the past, the initial mill had to be pulled out of the hole and replaced before the window was milled sufficiently large to allow the secondary mill to enter and finish the window. One of the reasons this occurred was that the initial mill was unstable and tended to initially jam. Additionally, when running on coiled tubing and pressurizing the coiled tubing, the result which occurred was an elongation of the tubing. To compensate for such an elongation, operators would lift up on the assembly so that the downhole motor would not start the initial mill when the initial mill is jammed between the face of the whipstock and the casing. To compensate for the elongation of the coiled tubing, the initial mill would be started when it was in a position well above the whipstock. Prior attempts to mill through tubing have used aggressive designs for the initial mill, such as shown in FIGS. 1 and 2. Those designs could strike the top of the whipstock, which could break cutters off. The mill would stick and stall the downhole motor, which could not put out sufficient torque to maintain rotation of such aggressively designed mills. The stalling of the mill, combined with applying a pickup force at the surface which would get the mill rotating, followed by once again lowering the mill into cutting position, put severe loads on the cutting structure of such mills and, as a result, the tungsten-carbide cutters would be broken off, greatly contributing to the early failure of the starter mill. Thus, one of the objectives of the present invention is to combine a more gradual angle in the starter mill, in combination with a stabilizer or guide which allows the mill to start when it is already in the vicinity of the whipstock after pressurization of the coiled tubing and the resultant expansion. Jamming and stalling are minimized, which promotes the useful life of the mill. Another objective is to provide, in a small confined space designed for thru-tubing, an initial mill that has a multiplicity of rows of cutters so that even if some break off, the rate of milling is not dramatically adversely affected. Thus, for example, in a mill having an outside diameter as small as about 3", as many as 12 rows of cutters can be used alongside of the lead mill.

SUMMARY OF THE INVENTION

A one-trip, window-milling system method and apparatus is disclosed. The system is particularly useful in thru-tubing applications where the mills are run on coiled tubing in conjunction with a downhole motor. Preferably, the whipstock is run through tubing and set in position. The mill assembly is typically run in after the thru-tubing whipstock is oriented and set. The mill assembly is supported by a downhole motor, which is in turn run-in with coiled tubing. The pilot mill or leading mill is of a particular shape so as to minimize its torque requirements for initiating the window. A wear device, which acts as a guide, is located behind the initial mill and acts with a flexible connector above the subsequent mills in orienting the initial mill into the casing and away from the whipstock. The subsequent mill or mills feature a gradual increase in cross-sectional area along its or their length, also minimizing the required torque for the downhole motor. The system is capable of penetrating thick casing such as standard weight 7" casing in approximately 3 hours or less.

DETAILED DESCRIPTION OF THE PREFERRED EMBODIMENT

Figure 4:
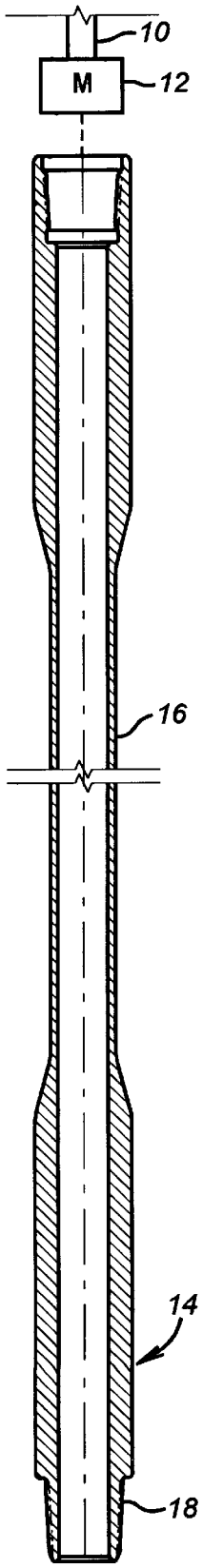
FIG. 4 is a sectional elevational view of a flexible connection placed between a downhole motor and the mill shown in FIG. 5.
Figure 5:
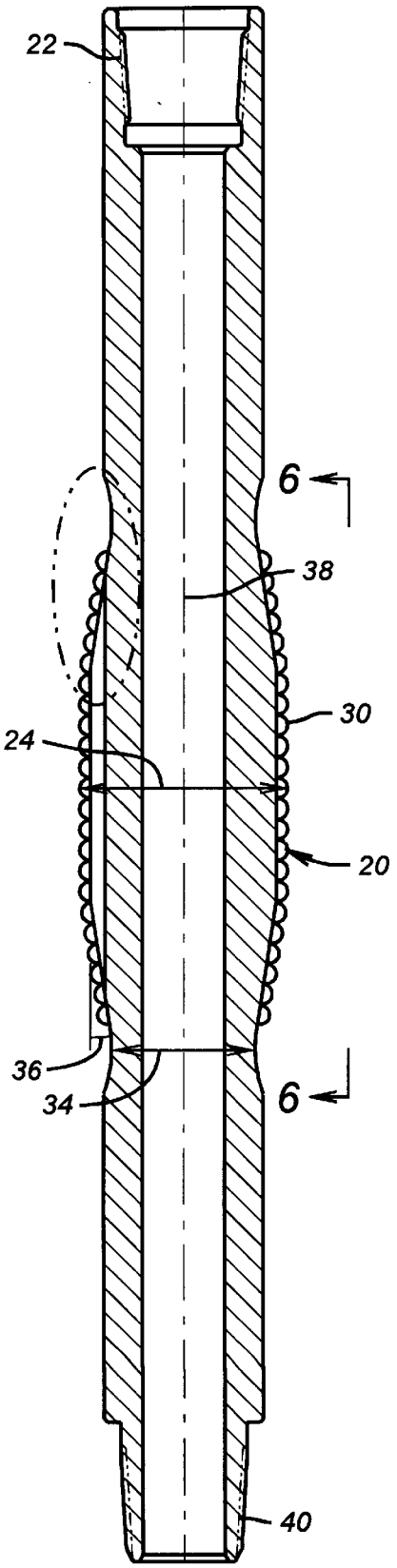
FIG. 5 is a sectional elevational view of a second-stage mill placed below the flexible joint of FIG. 4.
Figure 8:
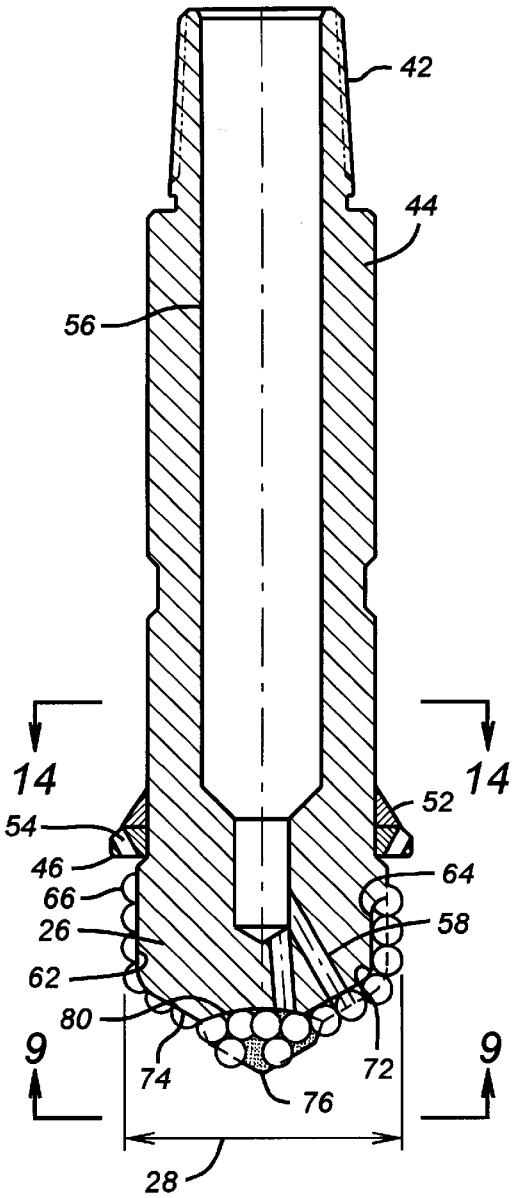
FIG. 8 is a section view further down on the assembly, showing the starter mill and the guide ring.
Figure 10:
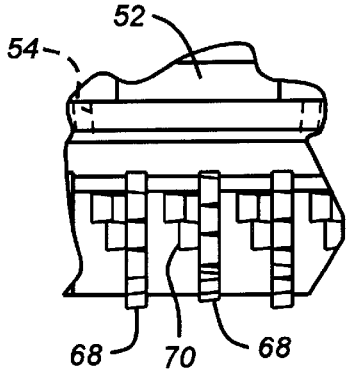
FIG. 10 is the view along lines 10—10 of FIG. 8.

The preferred assembly is best seen by looking consecutively at FIGS. 4, 5, and 8. In the preferred embodiment, a coiled tubing string 10 supports a downhole mud motor 12. Below the mud motor 12 is a flexible joint 14. The flexible joint 14 has a thin section 16 to give it flexibility. Thus, for example, for a flexible joint having an outer diameter of 2.875", the diameter of the thin section 16 is 1.875". Connected at thread 18 of flexible joint 14 is a secondary mill or mills 20. Mill 20 has an upper thread 22, which is secured to thread 18 so that the mill 20 is supported from the flexible joint 14. While a single spiral-type mill is illustrated as the secondary mill, a different design can be employed and different quantities of discrete mills can be employed as the secondary mill or mills without departing from the spirit of the invention. The significant features of the preferred embodiment for the secondary mill or mills 20 are an outer diameter, represented by arrow 24, which exceeds the outer diameter of the primary mill 26, shown in FIG. 8 and represented by arrow 28. The mill 20 has tungsten-carbide cutters 30 arranged in a predetermined pattern. Looking at FIG. 6, spiral gaps 32 are indicated in this style of mill 20. As shown in FIG. 5, the diameter of mill 20 increases gradually to that represented by arrow 24 from the diameter at arrow 34. Thus, the diameter at arrow 34 is only slightly smaller than the diameter indicated by arrow 28 for the primary mill 26. Thus, as the window is being milled and the primary mill 26 has already advanced to begin the window, the conclusion of the window by the backup mill or mills 20 is smoothly concluded with minimal torque requirements due to the gradual increase in diameter as the mill or mills 20 advance. Thus, the angle 36, measured from a line parallel to the longitudinal axis 38, is fairly small in the order of less than 10°0, both at the leading end adjacent arrow 34 and at the opposite trailing end of the mill 20. At the lower end of mill 20 is thread 40, which through a sub or subs (not shown) is ultimately connected to thread 42. Primary mill 26 has a body 44 extending from thread 42. Connected to body 44 adjacent the mill 26 is guide 46. Guide 46 preferably takes the form of a ring (see FIG. 14) which will wear as the mill 26 turns. Some preferred materials are brass or bronze. In conjunction with the flexible joint 14, the ring 46 acts as a fulcrum, biasing the mill 26 from the face 48 of the whipstock 50, shown in FIG. 13, as described in U.S. Pat. No. 5,697,438, entitled *Torque Control Device for Downhole Milling*, and is fully incorporated herein as if fully set forth. As shown in FIGS. 8 and 10, transition wear pads 52 are distributed, preferably in a 90° pattern and straddling longitudinal openings 54. These have ground carbide to assist in milling on the way out of the window to facilitate removal of the assembly. Openings 54 can have different shapes, such as slots, as indicated in FIG. 14.

Internal to the body 44 is a passage 56 to conduct fluid from the surface through the coiled tubing 10 and out through outlets 58 so as to take cuttings away during the milling using mill 26. The outer diameter of the guide 46 is preferably larger than the initial diameter of the mill 26, as indicated by arrow 28. Those skilled in the art will appreciate that during milling, the guide 46 wears down so that its diameter gets smaller. However, by that time the initial penetration by the mill 26 has occurred and the guide 46 has essentially served its purpose.

Figure 11:
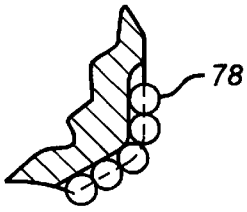
FIGS. 11 and 12 show successive rows of cutters on the starter mill, showing the offset orientation of the cutters between rows.
Figure 9:
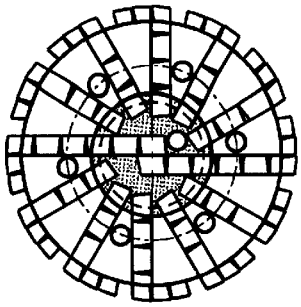
FIG. 9 is the view along lines 9—9 of FIG. 8.
Figure 12:
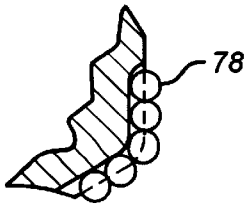

The overall shape of the mill 26 in the preferred embodiment is revealed in FIG. 8. It has relatively straight sides 26 defining a plurality of vertical slots 64 such that tungsten-carbide cutters 66, which are round, can extend half into slot 64 and half out. Thus, as seen in FIG. 10, there are a plurality of rows 68 which are parallel to each other around the circumference of the mill 26. As shown in FIG. 9, there are 12 rows 68 for a mill 26 of about 3" in diameter. One such row 68 is illustrated at the right-hand side of FIG. 8. In between the rows 68 are additional cutters 70, which are preferably half-rounds mounted on the outside diameter of the mill 26 and dressed in a left-hand helix, with preferably brass between the rows 68 and the cutters 70. A rounded transition 72 leads to a tapered segment 74 which is preferably at about 45°. The tapered segment 74 comes to a point 76. As shown in FIGS. 11 and 12, the cutters as between parallel rows 68 are offset. Thus, for example, looking at FIGS. 11 and 12, the cutters 78 start lower in FIG. 11 than they do in FIG. 12, with FIGS. 11 and 12 representing parallel rows 68 as depicted in FIG. 10. This allows fresh cutters to become available as the milling progresses.

It should be noted that the point 76 is a built-up area with a binder material called Superloy®, as sold by Baker Oil Tools on its mills, or another known binder material, and is a binder for the cutters at the lower end of the mill 26. The tapered segment 74 actually transitions to a concave surface 80 upon which the cutters at the lower end are disposed in a binder which is preferably inclusive of chunks of tungsten-carbide.

The openings 54, which are preferably longitudinal bores through the guide 46, allow circulation past the guide 46 while milling is occurring with mill 26. The ring nature of the guide 46 also promotes stability of the mill 26 while the flow through the openings 54 are further aids to stability during rotation.

Figure 13:
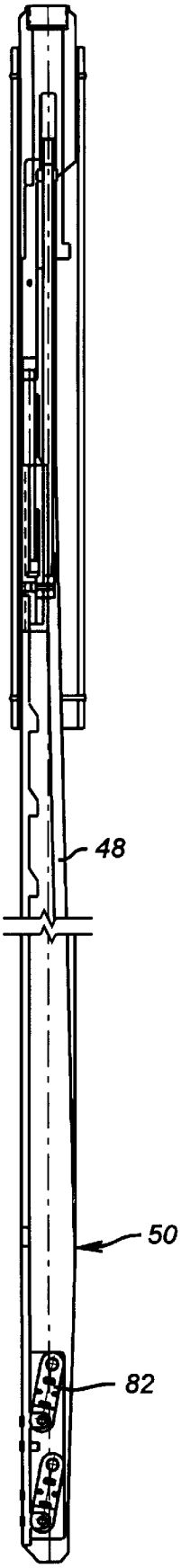
FIG. 13 is a sectional view of a whipstock for thru-tubing applications.
Figure 14:
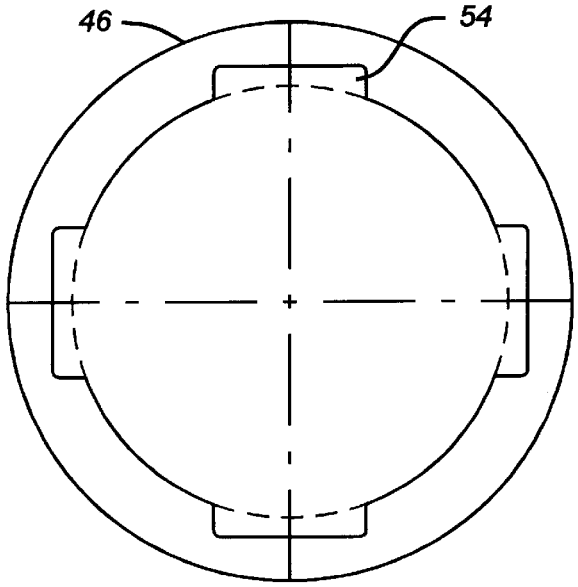
FIG. 14 is the section view along lines 14—14 of FIG. 8.

Referring now to FIG. 13, a thru-tubing insertable whipstock of a known design 50 is illustrated. It has an anchoring mechanism through a linkage system 82.

Accordingly, several of the features described above, individually and in combination, result in an efficient technique for cutting through a casing (not shown). The bottom end of the mill 26 has a very gradual angle and employs rounded tungsten-carbide cutters, in multiple rows in a small diameter, in the tradition of a well-known product line of Baker Oil Tools known by the trademark METAL MUNCHER®. However, to accommodate the lower torque available from using the downhole motor 12, as opposed to rotating from the surface through a string, the gradual angle and rounded transition 72 assist in allowing the window to start and the mill 26 to work within the torque limitations of the motor 12. The guide 46, combined with the flex joint 14, acts as a fulcrum for the mill 26 to push it away from the face 48 of the whipstock 50 so that the rows 68 can make the initial engagement with the casing in conjunction with the cutters on the tapered segment transition 74 and extending down to point 76. Jamming and cutter breakage are reduced. The guide 46 is made slightly larger than the initial O.D. of the mill 26 so that it performs its purpose of acting as a fulcrum without being initially worn down as the milling starts. Ultimately, after a certain amount of milling occurs with mill 26, the guide 46 makes contact with the whipstock face 48 and begins to wear, as is intended. Eventually, as the mill 26 progresses into the window, the guide 46 moves away from the whipstock face 48, having served its purpose. The width 24 of the secondary mill 20 is made somewhat larger than the initial width or diameter of the mill 26. Thus, it takes a combination of the mills 20 and 26, regardless of whether one or more mills 20 is used, to fully make the hole. The layout of the cutters in the backup mill 20 again resembles the configuration of the known Baker Oil Tools METAL MUNCHER designs, such as, for example, illustrated in U.S. Pat. Nos. 5,038,859 or 5,086,838.

Figure 6:
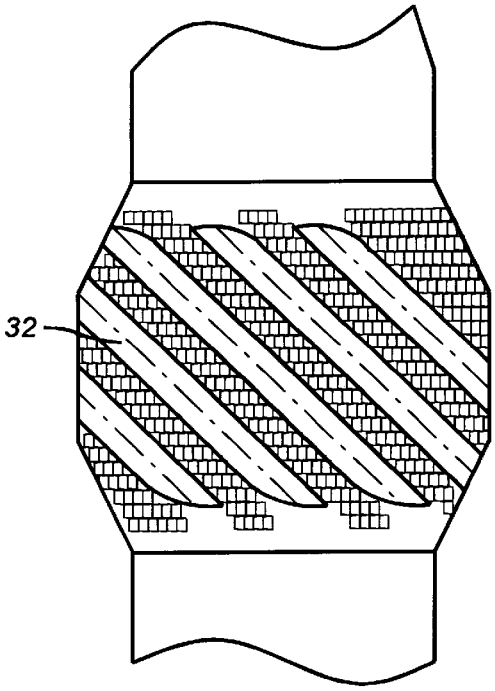
FIG. 6 is the view along lines 6—6 of FIG. 5.
Figure 7:
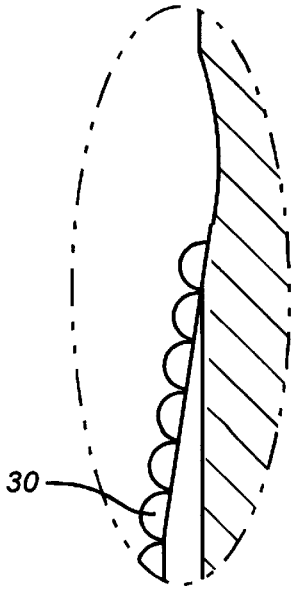
FIG. 7 is a detailed view of the cutters shown in FIG. 5.

The openings 54 in guide 46 promote the return flow to the surface and the removal of cuttings, as well as add to the stability of the rotating mill 26. The openings 54 can be provided for in a variety of ways, such as providing breaks or discontinuities in the guide 46 or just providing external notches in the guide 46. However, in the preferred embodiment, longitudinal bores have been found to be more effective in providing stabilization to the rotating mill 26. Thus, a one-trip, thru-tubing system, powered by a downhole motor 12, is illustrated where an initial mill 26 makes a portion of the window, aided by guide 46 and a backup mill or mills 20, preferably having a spiral design, as indicated in FIG. 6, with a METAL MUNCHER tungsten-carbide rounded cutter layout, acting to finish the window. The very gradual transition used in the backup mill 20 also facilitates the cutting rate through the casing.

Figure 1:
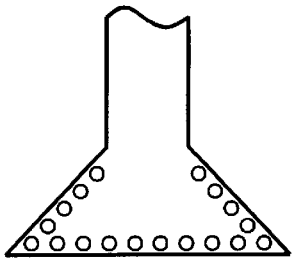
(PRIOR ART) FIG. 1
FIG. 1 is a section view of a prior art mill.
Figure 2:
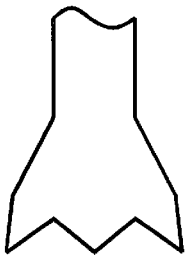
(PRIOR ART) FIG. 2
FIG. 2 is a section view of another prior art mill.
Figure 3:
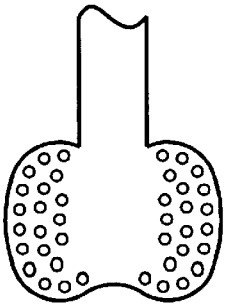
(PRIOR ART) FIG. 3
FIG. 3 is a section view of another prior art mill.

The design of the initial mill 26 should be compared to some of the prior art initial mills which are unworkable in conjunction with a downhole motor, such as 12. The designs shown in FIGS. 1 and 2 are for aggressive cutting with the rotary power provided by the rig through a tubing string. The shape illustrated in FIG. 3 is more for lighter duty applications and, while it can be powered with a downhole motor, such as 12, it is incapable, when used in conjunction with carbide particles distributed on its exterior, to make an initial penetration into the casing sufficient to allow the backup mill to be of use. In essence, using the prior art shape of FIG. 3, the mill wears out before a sufficient window can be cut, thus necessitating multiple trips just to make the initial portion of the window. The shape as illustrated in FIG. 8, in conjunction with the other design details as mentioned, is conducive to rapid penetration through the casing.

The foregoing disclosure and description of the invention are illustrative and explanatory thereof, and various changes in the size, shape and materials, as well as in the details of the illustrated construction, may be made without departing from the spirit of the invention.

What is claimed is:

1. A one-trip window-milling method through existing tubing using a positioned whipstock, comprising:

running in through well tubing at least one mill and a downhole motor supported on coiled tubing;

configuring said mill to cut the desired window to its finished dimension;

providing a leading mill with a bottom, a longitudinal axis, and a subsequent mill having a transition thereon;

configuring said leading mill to cut a portion of the desired window;

expanding the window with said transition to its finished dimension;

providing a guide on said leading mill to assist in directing cutters on said leading mill away from the whipstock when the window is milled;

providing at least one transition wear pad adjacent said guide having a cutting capability to facilitate extraction of said leading mill from the portion of the window it just milled.

2. The method of claim 1, further comprising:

providing a flexible mount to allow said guide to act as a fulcrum to urge cutters on said leading mill away from said whipstock.

3. The method of claim 2, further comprising:

providing a taper on the bottom of said leading mill of at least about 45° measured from the longitudinal axis of said leading mill.

4. The method of claim 3, further comprising:

providing a transition in size on said subsequent mill at less than about 10° measured from the longitudinal axis of said subsequent mill.

5. The method of claim 4, further comprising:

providing a return passage for cuttings through said guide.

6. A one-trip window-milling method through existing tubing using a positioned whipstock, comprising:

running in through well tubing at least one mill and a downhole motor supported on coiled tubing;

configuring said mill to cut the desired window to its finished dimension;

providing a leading mill with a bottom, a longitudinal axis, and a subsequent mill having a transition thereon;

configuring said leading mill to cut a portion of the desired window;

expanding the window with said transition to its finished dimension;

providing a guide on said leading mill to assist in directing cutters on said leading mill away from the whipstock when the window is milled;

providing a flexible mount to allow said guide to act as a fulcrum to urge cutters on said leading mill away from said whipstock;

providing a taper on the bottom of said leading mill of at least about 45° measured from the longitudinal axis of said leading mill;

providing a transition in size on said subsequent mill at less than about 10° measured from the longitudinal axis of said subsequent mill;

providing a return passage for cuttings through said guide;

providing at least one transition wear pad adjacent said guide having a cutting capability to facilitate extraction of said leading mill from the portion of the window it just milled.

7. The method of claim 6, further comprising:

providing multiple parallel rows of cutters with space in between;

using the space between rows of said cutters to direct return flow with cuttings;

offsetting cutters from one row to the next.

8. The method of claim 7, further comprising:

providing spiral return paths for cuttings through cutter on said subsequent mill.

9. The method of claim 8, further comprising:

providing an outside diameter on said leading mill of no more than about 3 inches and with up to 12 rows of cutters.

10. The method of claim 1, further comprising:

providing a taper on the bottom of said leading mill of at least about 45° measured from the longitudinal axis of said leading mill.

11. The method of claim 1, further comprising:

providing a transition in size on said subsequent mill at less than about 10° measured from the longitudinal axis of said subsequent mill.

12. The method of claim 1, further comprising providing a return passage for cuttings through said guide.

13. A method of milling a window through existing tubing, comprising:

supporting an assembly of a downhole motor and at least one mill on coiled tubing;

inserting and orienting a whipstock through tubing;

positioning said assembly adjacent said whipstock;

configuring said mill so that cutters on it will be pushed away from said whipstock;

actuating said downhole motor to mill a window in a single trip;

providing a leading and a subsequent mill, each having a longitudinal axis;

configuring said leading mill so that cutters on it will be pushed away from said whipstock;

flexibly mounting said leading mill;

providing a guide on said leading mill which works in conjunction with said flexible mounting to keep the cutters on said leading mill away from the whipstock;

providing at least one transition wear pad adjacent said guide having a cutting capability to facilitate extraction of said leading mill from the portion of the window it just milled.

14. The method of claim 13, further comprising:

providing a blunt nose on said leading mill having an angle of at least about 45° from the longitudinal axis of said leading mill.

15. The method of claim 13, further comprising:

providing a taper on said subsequent mill of about 10° or less measured from the longitudinal axis of said subsequent mill.

* * * * *